313-422 SR
2/2/88 OR 4,723,090

United States Patent [19]
Maeda et al.

[11] Patent Number: 4,723,090
[45] Date of Patent: Feb. 2, 1988

[54] CATHODE RAY TUBE

[75] Inventors: Makoto Maeda, Tama; Michio Tamura, Fujisawa, both of Japan

[73] Assignee: Sony Corporation, Tokyo, Japan

[21] Appl. No.: 945,239

[22] PCT Filed: Mar. 23, 1984

[86] PCT No.: PCT/JP84/00131

§ 371 Date: Nov. 21, 1984

§ 102(e) Date: Nov. 21, 1984

[87] PCT Pub. No.: WO84/03796

PCT Pub. Date: Sep. 27, 1984

Related U.S. Application Data

[63] Continuation of Ser. No. 678,690, Nov. 21, 1984, abandoned.

[30] Foreign Application Priority Data

Mar. 24, 1983 [JP] Japan ..... 58-49617

[51] Int. Cl.[4] ..... H01J 29/86; H01J 29/88

[52] U.S. Cl. ..... 313/422; 313/477 R; 313/479

[58] Field of Search ..... 313/422, 477 R, 479

[56] References Cited

FOREIGN PATENT DOCUMENTS 11212 5/1969 Japan ..... 313/422

*Primary Examiner*—Palmer C. DeMeo
*Attorney, Agent, or Firm*—Hill, Van Santen, Steadman & Simpson

[57] ABSTRACT

The present invention relates to a cathode ray tube suitable for use with a flat type cathode ray tube in which a material from which a secondary electron is emitted by the impingement of an electron beam is exposed on a surface of an area of a first panel portion (2) having on its inner surface formed a phosphor screen on which the electron beam from an electron gun impinges and an insulative material which forms a second panel portion (3) is exposed on an inner surface of the second panel portion (3) opposing the first panel portion (2) wherein the secondary electron is accumulated to present a predetermined high potential state so that an electric field is prevented from being disturbed in a path of the electron beam.

3 Claims, 4 Drawing Figures

CATHODE RAY TUBE

This is a continuation of application Ser. No. 678,690, filed Nov. 21, 1984 now abandoned.

TECHNICAL FIELD

The present invention relates to a cathode ray tube and more particularly to a flat type cathode ray tube.

BACKGROUND ART

In a cathode ray tube such as a cone type television tube the whole of the inner surface of its envelope from the periphery at the electron beam emitting end of an electron gun to a phosphor screen there is an inner conductive film made by coating carbon thereon. A constant high voltage is applied to the inner conductive film whereby the electron beam emitted from the electron gun can be stably directed to the phosphor screen.

The above structure was provided because when the glass surface of the cathode ray tube proper or the surface of the insulating material faces the path of the electron beam, an unstable electric charge is stored on the surface of the insulating material which may cause a disturbance of the electric field in the path of the electron beam to thereby cause a displacement of the scanning position of the electron beam and hence to generate flicker of distortion in the picture. Previously, the present assignee proposed a flat type cathode ray tube consisting of a flat glass envelope 1 whose view in perspective is shown in FIG. 1 and whose cross-sectional view is shown in FIG. 2. This glass envelope 1 is formed of first and second panel portions 2 and 3 which are opposed to each other to establish a flat space 7 therebetween. The panels are bonded together by frit-sealing and a funnel portion 4 is similarly bonded to one side of the first and second panel portions 2 and 3 by frit-sealing. The funnel portion 4 is so formed that its open end 4*a* of large diameter is contacted and sealed to the first and second panel portions 2 and 3 while to its open end 4*b* of small diameter there is welded a neck portion 5 within which an electron gun 6 is located.

The first and second panel portions 2 and 3 comprise, as shown in their exploded and perspective view in FIG. 3, main faces 2*a* and 3*a* which oppose each other and peripheral side faces 2*b* and 3*b* which extend from three side edges other than side edges bonded to the funnel portion 4. The end surfaces of the peripheral side faces 2*b* and 3*b*, which oppose each other, are frit-bonded to establish the flat space 7 between both the panel portions 2 and 3. In order that the flat funnel-shaped space of the funnel portion 4 communicate with the flat space 7, to the side edge portions of the panel portions 2 and 3 where there exist no peripheral side faces the large diameter opening 4a is contacted and sealed by frit-bonding.

On the inner surface of the face 2*a* of the first panel portion 2, there is formed a conductive layer 8 made of a vapor deposited aluminum film and thereon a phosphor screen 9 is formed by, for example, electrodeposition. A protective film 10 is coated on the phosphor screen 9 and a transparent conductive layer 11 made of a vapor deposited film is coated on the protective layer so as to cover the whole inner surface of, for example, the first panel portion 2. Further, on the inner surface of the funnel portion 4 there is an inner conductive film 13 made of a carbon coating film or the like. An anode button 14 for applying a high voltage is provided through the funnel portion 4, for example, at one side which is electrically connected to the inner conductive film 13. From this anode button through the inner conductive layer 13 to the transparent conductive film 11 and hence to the phosphor screen 9 and the high voltage electrode of the electron gun 6, there is applied is a high anode voltage. The face 2*a* of the first panel portion 2 is so curved that the phosphor screen 9 formed on its inner surface opposite the axis of the electron gun 6, as it approaches the tip end of the envelope 1, namely the side opposite to the side near the location of the electron gun 6, it comes near or intersects the tubular axis so that the electron beam emitted from the electron gun 6 impinges on the phosphor screen 9 at about its center when the electron beam is not deflected. The electron beam emitted from the electron gun 6 is deflected by a horizontal and vertical electromagnetic deflection means 17 provided on, for example, the peripheral portion near the welded portion of the funnel portion 4 and the neck portion 5 such that it scans the phosphor screen 9 over a predetermined area horizontally and vertically. A light image emitted from the phosphor screen 9 by the excitation caused by the impingement of the electron beam thereon is viewed from the side of, for example, the face 3*a* of the second panel portion 3.

Even in the flat type cathode ray tube which is formed by integrally bonding the first and second panel portions 2 and 3 to the funnel portion 4 to which the neck portion 5 is welded, it is desired that similar to the cathode ray tube of an ordinary television receiver, the electron beam path at the side of the phosphor screen should be surrounded by the conductive film to which the high constant voltage is applied as described above to prevent the electric field for the electron beam path from being disturbed.

Therefore, in such a flat type cathode ray tube, on the inner surface of the second panel portion 3, a transparent conductive film 12 is evaporated over the whole area thereof to which the high voltage is applied through the anode button 14. In case of such structure, the transparent conductive films 11 and 12 respectively coated on the inner surfaces of the first and second panel portions 2 and 3 are supplied with the high voltage by electrically connecting the conductive films to the inner conductive film 13 of the funnel portion 4. However, in the portions between the respective conductive films 11, 12 and 13 there are connecting surfaces formed by the frit-bonding of the respective panel portions 2, 3 and the funnel portion 4 so that the conductive films 11, 12 and 13 can not be electrically connected. Accordingly, it is necessary that in this case after the respective portions 2, 3 and 4 are frit-bonded, the respective conductive films 11 and 12 are electrically connected to the inner conductive film 13. This electrical connection is carried out such that before electron gun 6 is inserted into the inside of the neck portion 5 bonded to the funnel portion 4, a special device is inserted into the envelope from the rear opening end of a neck portion 5 and the conductive material such as carbon paint or the like adhered to the tip end of the above device is coated across the frit-bonded portions of the funnel portion 4 to the first and second panel portions 2 and 3 and bridges parts of the conductive film 13 and films 11 and 12 to thereby provide connecting portions 15 and 16 which electrically couple the conductive film 13 with films 11 and 12.

In such a flat type cathode ray tube, in order to surround entirely the periphery of the electron beam path directed to the phosphor screen, namely, the entire periphery of the flat space by a conductive film, the expensive transparent conductive film is coated on both the inner surfaces of the first and second panel portions 2 and 3. Especially for the second panel portion 3, this procedure is not only expensive but also complicated. Providing two coupling conductive portions 15 and 16 made of carbon paint or the like across the frit-bonded portions is very complicated and prevents its mass-production.

In view of the above defects of the prior art, the present invention seeks to reduce the area on which the transparent conductive film is coated as much as possible to thereby reduce the cost, simplify the workability and also increase the reliability.

DISCLOSURE OF INVENTION

According to the present invention, it was found that even if a conductive film is not formed on the entire periphery of the electron beam path at the side of the phosphor screen and a predetermined voltage is applied thereto, the electric field in the electron beam path can be stabilized.

That is, in the present invention, on the whole or at least a part of the electron beam scanning area on which the electron beam impinges at the side of the first panel portion, a layer of material, which generates a secondary electron beam when the electron beam impinges thereon, is provided, whereby no transparent conductive film is provided at least on the second panel portion. And, even if the surface of insulating material which forms the panel portion itself, for example, the glass surface is exposed, when the electron beam impinges upon the phosphor screen, namely, the cathode ray tube begins to be driven, secondary electrons are emitted so that this secondary electron beam is accumulated so as to cover the surface of the insulative material coated on the inner surface of the second panel portion, thus applying a constant potential to the inner surface thereof.

BEST MODE FOR CARRYING OUT THE INVENTION

Figure 1:
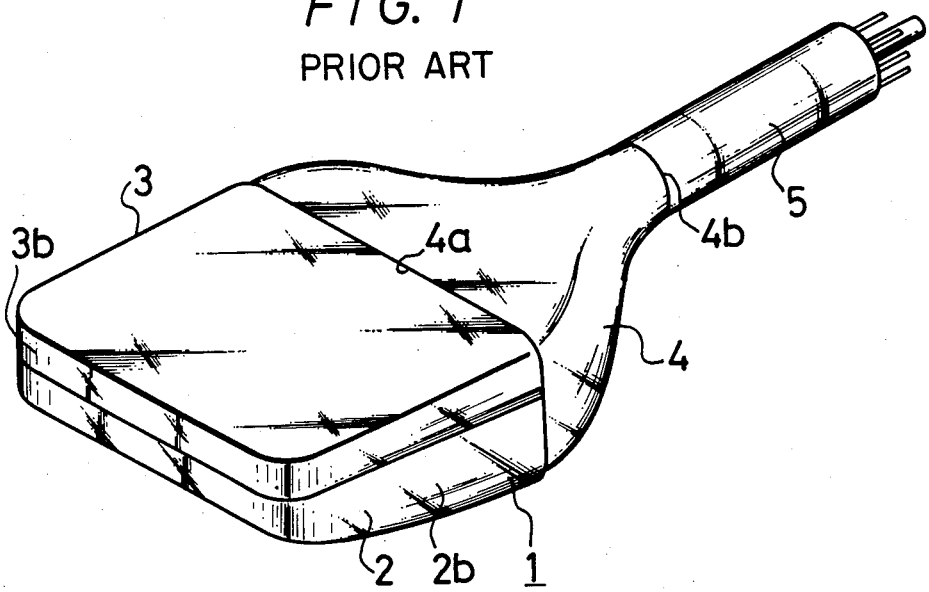
FIG. 1 PRIOR ART
FIGS. 1 and 2 are respectively a perspective view and a longitudinally cross-sectional view of a flat type cathode ray tube useful for explaining the present invention.
Figure 2:
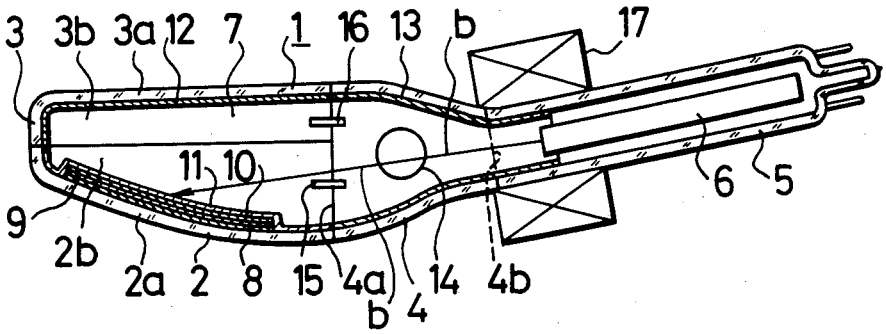
FIG. 2 PRIOR ART
Figure 3:
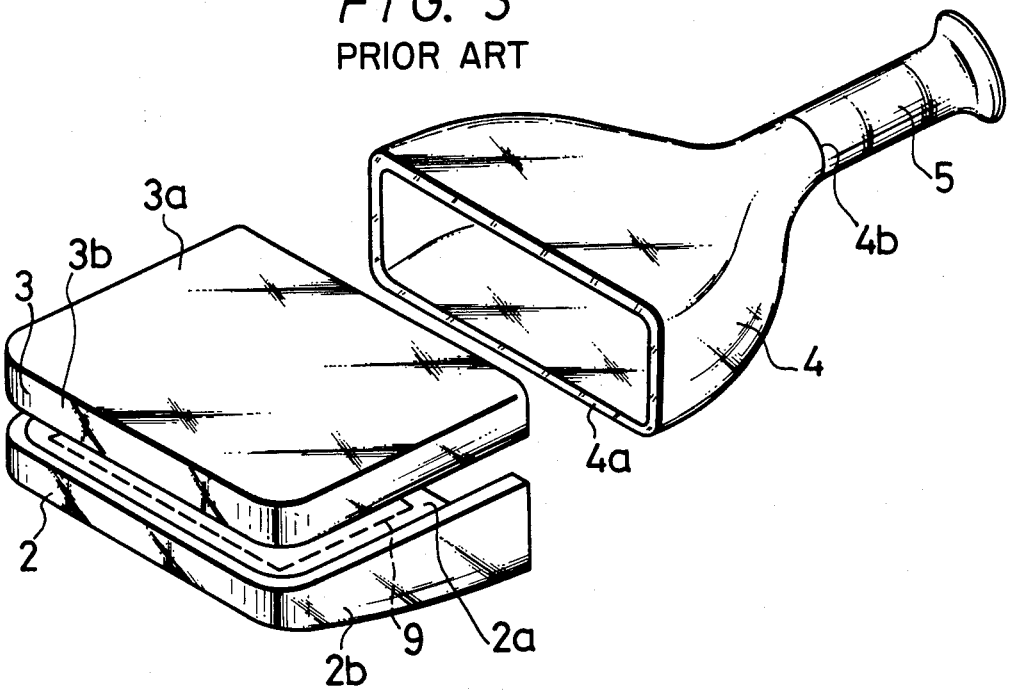
FIG. 3 PRIOR ART
FIG. 3 is an exploded perspective view of a tube envelope thereof and FIG. 4 is a longitudinal cross-sectional view of an embodiment of a cathode ray tube according to the present invention.
Figure 4:
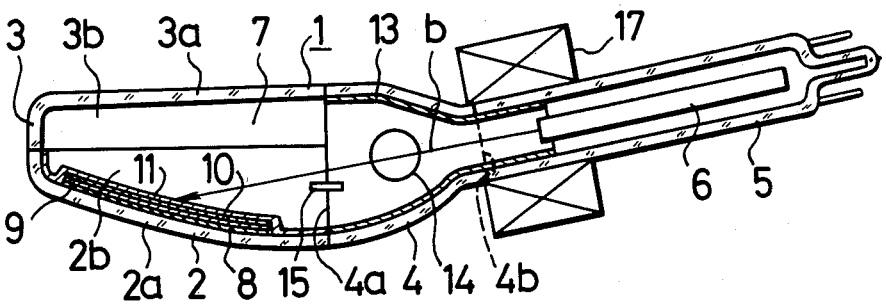

An embodiment of a cathode ray tube, particularly a flat type cathode ray tube according to the present invention will be described with reference to FIG. 4. Also in this embodiment, the envelope 1 of the cathode ray tube is formed such that the first and second panel portions 2 and 3 and the funnel portion 4 to which the neck tube 5 incorporating therein the electron gun 6 is welded are integrally bonded by frit-sealing and the like. In FIG. 4, like parts corresponding to those in FIG. 2 are marked with the same reference numerals and will not be described. Particularly in this invention, the transparent conductive film 12 described in connection with FIG. 2 is not deposited on the inner surface of the second panel portion 3 but the insulative material which forms the panel portion 3, for example, the glass surface is directly exposed and opposed to the side of the phosphor screen 9.

Further in accordance with the present invention, the whole area on which the electron beam b from the electron gun 6 impinges, namely, the portion corresponding to the scanning area of the electron beam, or at least a part of the surface layer thereof is formed in material of which the secondary electron emitting ratio is relatively high. For example, when the transparent conductive film 11 is formed so as to cover the phosphor screen 9, the transparent conductive film is formed of material having a relatively high secondary electron emitting ratio, for example, an evaporated film of a composite oxide film (ITO) of In and Sn. This transparent conductive film 11 is formed on, for example, the whole inner surface of the first panel 2 similarly as mentioned before and electrically coupled with the inner conductive film 13 of the funnel portion 4 by the coupling conductive layer 15 which is coated after the frit-sealing as mentioned similarly to FIG. 2. Through this transparent conductive film 11, the high voltage can be applied to the phosphor screen from the anode button 14. This transparent conductive film 11 is formed on the protective film 10 formed on the phsophor screen 9. In practice, the surface of the phosphor screen 9, namely, the surface of the electrodeposited film of phosphor powder has very small concave and convex portions. On the other hand, the protective film 10 and the transparent conductive film 11 formed on the above surface are both formed sufficiently thin so that the phosphor screen 9 can be efficiently excited by the electron beam. As a result, the surface is not fully covered with the transparent conductive film 11 so that microscopically a part of the protective film 10 or a part of phosphor of the phosphor screen 9 is exposed. Accordingly, in this case, the protective film 10 is formed of a silicon oxide having a relatively high secondary electron emitting ratio, namely, SiO, $SiO_2$, a mixture thereof or an intermediate form thereof. Alternatively, the phosphor itself which forms the phosphor screen 9 is made of sulfide having a high secondary electron emitting ratio.

According to the configuration of the invention as mentioned above, since the material surface from which the secondary electron is emitted is exposed in the scanning area of the electron beam by the impingement of the electron beam thereon, at the same time when the cathode ray tube is starting to be driven, the secondary electrons are emitted, advanced toward, for example, the inner surface of the second panel portion 3 opposing thereto and accumulated therein. Since the potential of the secondary electrons are high, the inside of the tube can be held at a stable state of a predetermined high voltage in a short period of timè.

While in the above embodiment the transparent conductive film 11 is formed on the whole inner surface of the first panel portion 2, the transparent conductive film 11 may be formed only on, for example, the phosphor screen and a path for supplying a high voltage to the phosphor screen may be formed of a carbon layer and the like. In this case, even when a part of the first panel portion 2, namely, glass or an insulative material forming the same is exposed, a predetermined electrification state is formed by the accumulation of the secondary electrons generated from the above electron beam scanning area to thereby prevent the electric field from being disturbed in the path of the electron beam.

As described above, the inside of the cathode ray tube is stabilized by the emission of the secondary electrons. The reason why the inside of the cathode ray tube is stabilized was determined that since the space within the tube envelope is the flat space, in a relatively short time of period after the driving of the cathode ray tube is started, the glass exposed portion within the tube envelope is covered with the secondary electrons and a stable electrification state, namely, an equilibrium state is established.

As set forth above, according to the configuration of the invention, no conductive film is deposited at all on the inner surface of the second panel portion 3 so that an optical image from the phosphor screen is viewed from, for example, the side of the panel portion 3, without the expensive transparent conductive film on the inner surface of the panel portion being present. Further, since it is possible to avoid the formation of the coupling conductive layer 16 which, as shown in FIG. 2, is used to couple the inner conductive film 13 formed on the inner surface of the funnel portion 4 to the conductive film formed on the inner surface of this panel portion 3, reliability is made high and workability can be increased.

While in the above embodiment the present invention is applied to the cathode ray tube of so-called reflection type in which the optical image formed on the phosphor screen is viewed from the opposite side of the panel having the phosphor screen, the present invention is not limited to a cathode ray tube of such reflection type. It is needless to say that the present invention can be applied to a cathode ray tube of the so-called tranparent type in whcih the conductive layer 8 on the side of, for example, the phosphor screen 9 is formed as the transparent conductive film and the light emission of the phosphor screen is viewed from the outer side of the inner surface 2*a* of the panel portion with a similar effect being achieved.

In addition, it is clear that the present invention is not limited to the above embodiment but can be applied to cathode ray tubes of various kinds in which the first and second panel portions are opposed to each other with the similar effect being achieved.

We claim:

1. A cathode ray tube comprising:

a first panel portion having a phosphor screen on its inner surface, a transparent second panel viewing portion in opposed relation to said first panel, a funnel portion including a necked down portion, said funnel portion being bonded to said first and second panel portions, an electron gun disposed in said necked down portion, said first panel portion having a conductive undercoated layer and a material comprising an electrodeposited phosphor film which produces substantial secondary electron emission upon bombardment by an electron beam, said second panel portion including an uncoated surface on its inner surface directly facing said first panel portion, and being subject to electron bombardment from electron emission from said material, whereby electron bombardment by the electron gun on said first panel portion causes secondary electrons to accumulate on said inner surface of said second panel portion to create a stable electrical field within said tube in a short time.

2. A cathode ray tube according to claim 1, wherein said second panel portion is formed of transparent glass and the phosphor screen of said first panel portion is viewed through said second panel portion.

3. A cathode ray tube of flat type according to claim 1, wherein said first and second panel portions are formed substantially flat.

* * * * *